US008704859B2

(12) United States Patent
Greenebaum et al.

(10) Patent No.: US 8,704,859 B2
(45) Date of Patent: Apr. 22, 2014

(54) DYNAMIC DISPLAY ADJUSTMENT BASED ON AMBIENT CONDITIONS

(75) Inventors: Ken Greenebaum, San Carlos, CA (US); Brian Christopher Attwell, Vancouver (CA)

(73) Assignee: Apple Inc., Cupertino, CA (US)

( * ) Notice: Subject to any disclaimer, the term of this patent is extended or adjusted under 35 U.S.C. 154(b) by 539 days.

(21) Appl. No.: 12/968,541

(22) Filed: Dec. 15, 2010

(65) Prior Publication Data

US 2012/0081279 A1 Apr. 5, 2012

Related U.S. Application Data

(60) Provisional application No. 61/388,464, filed on Sep. 30, 2010.

(51) Int. Cl.
*G09G 3/36* (2006.01)

(52) U.S. Cl.
USPC ..... 345/690; 345/207; 345/589

(58) Field of Classification Search
USPC ..... 345/87–102, 204, 207, 690, 589–590
See application file for complete search history.

(56) References Cited

U.S. PATENT DOCUMENTS

| | | | | |
|---|---|---|---|---|
| 6,160,655 | A * | 12/2000 | Fix et al. | 359/265 |
| 2002/0180751 | A1* | 12/2002 | Rozzi | 345/589 |
| 2004/0008208 | A1* | 1/2004 | Dresevic et al. | 345/589 |
| 2005/0117186 | A1* | 6/2005 | Li et al. | 359/15 |
| 2006/0284895 | A1* | 12/2006 | Marcu et al. | 345/690 |
| 2008/0080047 | A1* | 4/2008 | Field et al. | 359/443 |
| 2008/0165292 | A1* | 7/2008 | Bing et al. | 348/744 |
| 2008/0303918 | A1* | 12/2008 | Keithley | 348/223.1 |
| 2010/0079426 | A1* | 4/2010 | Pance et al. | 345/207 |
| 2011/0141366 | A1* | 6/2011 | Yoon | 348/602 |

OTHER PUBLICATIONS

Marcu, Gabriel, "Gamut Mapping in Munsell Constant Hue Sections", The Sixth Color Imaging Conference: Color Science, Systems, and Applications, pp. 159-162 (1998).

Moroney, Nathan, et al., "The CIECAM02 Color Appearance Model", IS&T/SID Tenth Color Imaging Conference, pp. 23-27 (2002).

* cited by examiner

*Primary Examiner* — Hong Zhou
(74) *Attorney, Agent, or Firm* — Wong, Cabello, Lutsch, Rutherford & Brucculeri, LLP

(57) ABSTRACT

The techniques disclosed herein use a display device, in conjunction with various optical sensors, e.g., an ambient light sensor or image sensors, to collect information about the ambient conditions in the environment of a viewer of the display device. Use of these optical sensors, in conjunction with knowledge regarding characteristics of the display device, can provide more detailed information about the effects the ambient conditions in the viewer's environment may have on the viewing experience. A processor in communication with the display device may create an ambient model based at least in part on the predicted effects of the ambient environmental conditions on the viewing experience. The ambient model may be used to adjust the gamma, black point, white point, or a combination thereof, of the display device's tone response curve, such that the viewer's perception remains relatively independent of the ambient conditions in which the display is being viewed.

29 Claims, 15 Drawing Sheets

"RESHAPED DISPLAY RESPONSE"

"LOOK UP TABLE GAMMA ADJUSTMENT"

DYNAMIC DISPLAY ADJUSTMENT BASED ON AMBIENT CONDITIONS

CROSS-REFERENCE TO RELATED APPLICATION

This application claims priority to U.S. Provisional Application Ser. No. 61/388,464, entitled, "Dynamic Display Adjustment Based on Ambient Conditions" filed Sep. 30, 2010 and which is incorporated by reference in its entirety herein.

BACKGROUND

Gamma adjustment, or, as it is often simply referred to, "gamma," is the name given to the nonlinear operation commonly used to encode luma values and decode luminance values in video or still image systems. Gamma, $\gamma$, may be defined by the following simple power-law expression: $L_{out}=L_{in}^{\gamma}$, where the input and output values, $L_{in}$ and $L_{out}$, respectively, are non-negative real values, typically in a predetermined range, e.g., zero to one. A gamma value greater than one is sometimes called an encoding gamma, and the process of encoding with this compressive power-law nonlinearity is called gamma compression; conversely, a gamma value less than one is sometimes called a decoding gamma, and the application of the expansive power-law nonlinearity is called gamma expansion. Gamma encoding helps to map data into a more perceptually uniform domain.

Another way to think about the gamma characteristic of a system is as a power-law relationship that approximates the relationship between the encoded luma in the system and the actual desired image luminance on whatever the eventual user display device is. In existing systems, a computer processor or other suitable programmable control device may perform gamma adjustment computations for a particular display device it is in communication with based on the native luminance response of the display device, the color gamut of the device, and the device's white point (which information may be stored in an ICC profile), as well as the ICC color profile the source content's author attached to the content to specify the content's "rendering intent." The ICC profile is a set of data that characterizes a color input or output device, or a color space, according to standards promulgated by the International Color Consortium (ICC). ICC profiles may describe the color attributes of a particular device or viewing requirement by defining a mapping between the device source or target color space and a profile connection space (PCS), usually the CIE XYZ color space. ICC profiles may be used to define a color space generically in terms of three main pieces: 1) the color primaries that define the gamut; 2) the transfer function (sometimes referred to as the gamma function); and 3) the white point. ICC profiles may also contain additional information to provide mapping between a display's actual response and its "advertised" response, i.e., its tone response curve (TRC).

In some embodiments, the display device's color profile may be managed using the COLORSYNC® Application Programmer Interface (API). (COLORSYNC® is a registered trademark of Apple Inc.) In some embodiments, the ultimate goal of the COLORSYNC® process is to have an eventual overall 1.0 gamma boost, i.e., unity, applied to the content as it is displayed on the display device. An overall 1.0 gamma boost corresponds to a linear relationship between the input encoded lama values and the output luminance on the display device, meaning there is actually no amount of gamma "boosting" being applied.

A color space may be defined generically as a color model, i.e., an abstract mathematical model describing the way colors can be represented as tuples of numbers, that is mapped to a particular absolute color space. For example, RGB is a color model, whereas sRGB, AdobeRGB and Apple RGB are particular color spaces based on the RGB color model. The particular color space utilized by a device may have a profound effect on the way color information created or displayed on the device is interpreted. The color spaces utilized by both a source device as well as the display device in a given scenario may be characterized by an "ICC profile.

In some embodiments, image values, e.g., pixel luma values, enter a "framebuffer" having come from an application or applications that have already processed the image values to be encoded with a specific implicit gamma. A framebuffer may be defined as a video output device that drives a video display from a memory buffer containing a complete frame of, in this case, image data. The implicit gamma of the values entering the framebuffer can be visualized by looking at the "Framebuffer Gamma Function," as will be explained further below. Ideally, this Framebuffer Gamma Function is the exact inverse of the display device's "Native Display Response" function, which characterizes the luminance response of the display to input. However, because the inverse of the Native Display Response isn't always exactly the inverse of the framebuffer, a "Look Up Table" (LUT), sometimes stored on a video card, may be used to account for the imperfections in the relationship between the encoding gamma and decoding gamma values, as well as the display's particular luminance response characteristics.

The transformation applied by the LUT to the incoming framebuffer data before the data is output to the display device ensures the desired 1.0 gamma boost on the eventual display device. This is generally a good system, although it does not take into account the effect on the viewer of the display device's perception of gamma due to differences in ambient light conditions. In other words, the 1.0 gamma boost is only achieved in one ambient lighting environment, and this environment is brighter than normal office environment.

Today, consumer electronic products having display screens are used in a multitude of different environments with different lighting conditions, e.g., the office, the home, home theaters, and outdoors. Thus, there is a need for techniques to implement an ambient-aware system that is capable of dynamically adjusting an ambient model for a display such that the viewer's perception of the data displayed remains relatively independent of the ambient conditions in which the display is being viewed.

SUMMARY

The techniques disclosed herein use a display device, in conjunction with various optical sensors, e.g., an ambient light sensor, an image sensor, or a video camera, to collect information about the ambient conditions in the environment of a viewer of the display device. The display device may comprise, e.g., a computer monitor or television screen. Use of these various optical sensors can provide more detailed information about the ambient lighting conditions in the viewer's environment, which a processor in communication with the display device may utilize to create an ambient model based at least in part on the received environmental information. The ambient model may be used to enhance the display device's tone response curve accordingly, such that the viewer's perception of the content displayed on the display device is relatively independent of the ambient conditions in which the display is being viewed. The ambient model may be a function of gamma, black point, white point, or a combination thereof.

When an author creates graphical content (e.g., video, image, painting, etc.) on a given display device, they pick colors as appropriate and may fine tune characteristics such as hue, tone, contrast until they achieve the desired result. The author's device's ICC profile may then be used as the content's profile specifying how the content was authored to look, i.e., the author's intent. This profile may then be attached to the content in a process called tagging. The content may then be processed before displaying it on a consumer's display device (which likely has different characteristics than the author's device) by performing a mapping between the source device's color profile and the destination device's color profile.

However, human perception is not absolute, but rather relative; a human's perception of a displayed image changes based on what surrounds that image. A display may commonly be positioned in front of a wall. In this case, the ambient lighting in the room (e.g., brightness and color) will illuminate the wall behind the monitor and change the viewer's perception of the image on the display. This change in perception includes a change to tonality (which may be modeled using a gamma function) and white point. Thus, while COLORSYNC® may attempt to maintain a 1.0 gamma boost on the eventual display device, it does not take into account the effect on a human viewer's perception of gamma due to differences in ambient light conditions.

In one embodiment disclosed herein, information is received from one or more optical sensors, e.g., an ambient light sensor, an image sensor, or a video camera, and the display device's characteristics are determined using sources such as the display device's ICC profile. Next, an ambient model predicts the effect on a viewer's perception due to ambient environmental conditions. In one embodiment, the ambient model may then be used to determine how the values stored in a LUT should be modified to account for the effect that the environment has on the viewer's perception. For example, the modifications to the LUT may add or remove gamma or modify the black point or white point of the display device's tone response curve, or perform some combination thereof, before sending the image data to the display.

In another embodiment, the ambient model may be used to apply gamma adjustment or modify the black point or white point of the display device during a color adaptation process, which color adaptation process is employed to account for the differences between the source color space and the display color space.

In other embodiments, a front-facing image sensor, that is, an image sensor facing in the direction of a viewer of the display device, or back-facing image sensor, that is, an image sensor facing away from a viewer of the display device, may be used to provide further information about the "surround" and, in turn, how to adapt the display device's gamma to better account for effects on the viewer's perception. In yet other embodiments, both a front-facing image sensor and a back-facing image sensor may be utilized to provide richer detail regarding the ambient environmental conditions.

In yet another embodiment, a video camera may be used instead of image sensors. A video camera may be capable of providing spatial information, color information, field of view information, as well as intensity information. Thus, utilizing a video camera could allow for the creation of an ambient model that could adapt not only the gamma, and black point of the display device, but also the white point of the display device. This may be advantageous due to the fact that a fixed white point system is not ideal when displays are viewed in environments of varying ambient lighting levels and conditions. E.g., in dusk-like environments dominated by golden light, a display may appear more bluish, whereas, in early morning or mid-afternoon environments dominated by blue light, a display may appear more yellowish. Thus, utilizing a sensor capable of providing color information would allow for the creation of an ambient model that could automatically adjust the white point of the display.

In still another embodiment, an ambient-aware dynamic display adjustment system could perform facial detection and/or facial analysis by locating the eyes of a detected face and determining the distance from the display to the face as well as the viewing angle of the face to the display. These calculations could allow the ambient model to determine, e.g., how much of the viewer's view is taken up by the device display. Further, by determining what angle the viewer is at with respect to the device display, a Graphics Processing Unit (GPU)-based transformation may be applied to further tailor the display characteristics to the viewer, leading to a more accurate depiction of the source author's original intent and an improved and consistent viewing experience for the viewer.

Because of innovations presented by the embodiments disclosed herein, the ambient-aware dynamic display adjustment techniques that are described herein may be implemented directly by a device's hardware and/or software with little or no additional computational costs, thus making the techniques readily applicable to any number of electronic devices, such as mobile phones, personal data assistants (PDAs), portable music players, monitors, televisions, as well as laptop, desktop, and tablet computer screens.

DETAILED DESCRIPTION

This disclosure pertains to techniques for using a display device, in conjunction with various optical sensors, e.g., an ambient light sensor, an image sensor, or a video camera, to collect information about the ambient conditions in the environment of a viewer of the display device and create an ambient model based at least in part on the received environmental information. The ambient model may be a function of gamma, black point, white point, or a combination thereof. While this disclosure discusses a new technique for creating ambient-aware models to dynamically adjust a device display in order to present a consistent visual experience in various environments, one of ordinary skill in the art would recognize that the techniques disclosed may also be applied to other contexts and applications as well.

The techniques disclosed herein are applicable to any number of electronic devices with optical sensors: such as digital cameras, digital video cameras, mobile phones, personal data assistants (PDAs), portable music players, monitors, televisions, and, of course, desktop, laptop, and tablet computer displays. An embedded processor, such a Cortex® A8 with the ARM® v7-A architecture, provides a versatile and robust programmable control device that may be utilized for carrying out the disclosed techniques. (CORTEX® and ARM® are registered trademarks of the ARM Limited Company of the United Kingdom.)

In the interest of clarity, not all features of an actual implementation are described in this specification. It will of course be appreciated that in the development of any such actual implementation (as in any development project), numerous decisions must be made to achieve the developers' specific goals (e.g., compliance with system- and business-related constraints), and that these goals will vary from one implementation to another. It will be appreciated that such development effort might be complex and time-consuming, but would nevertheless be a routine undertaking for those of ordinary skill having the benefit of this disclosure. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Figure 1:
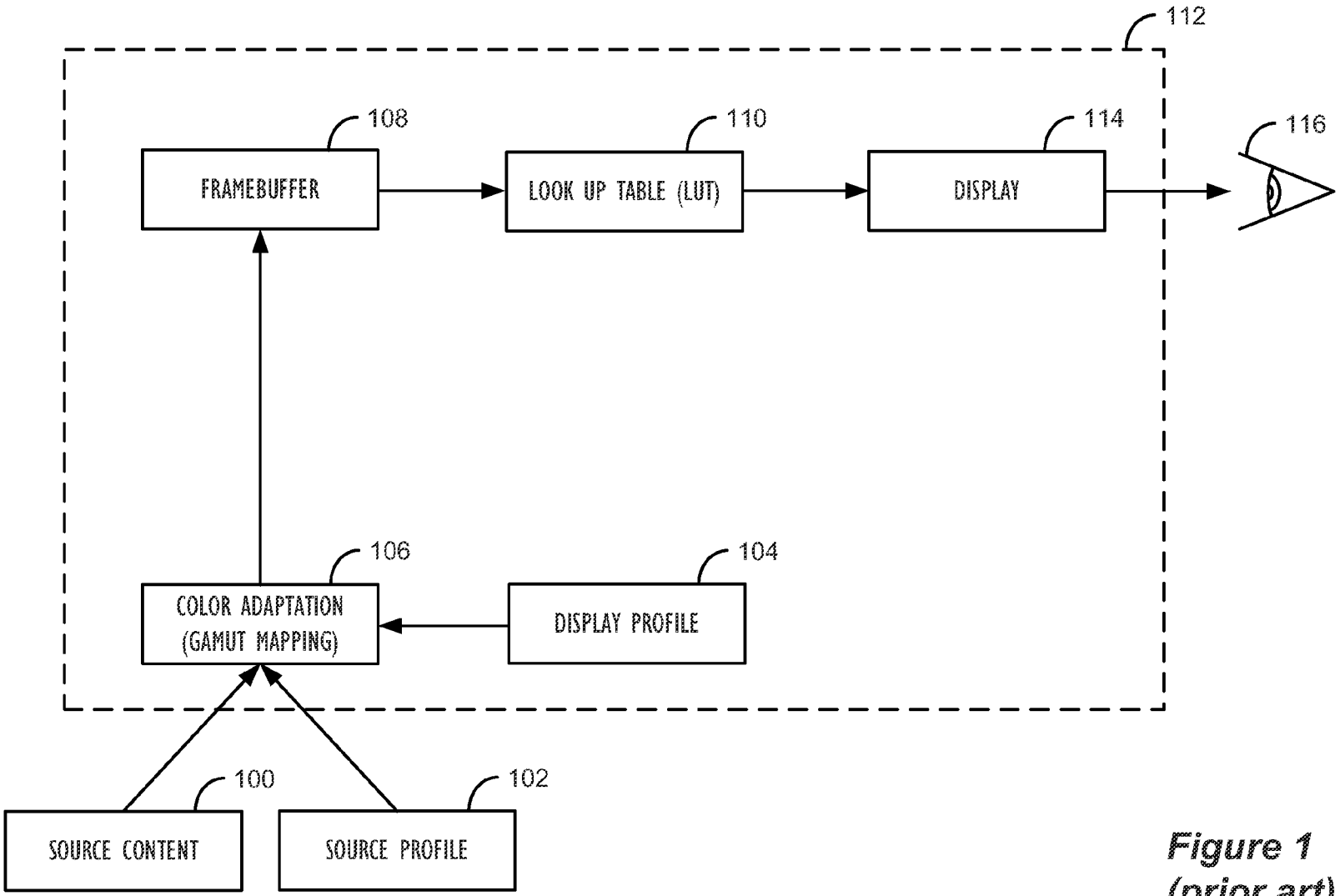
Figure 1 (prior art)
FIG. 1 illustrates a system for performing gamma adjustment utilizing a look up table, in accordance with the prior art.

Referring now to FIG. 1, a system 112 for performing gamma adjustment utilizing a Look Up Table (LUT) 110 is shown. Element 100 represents the source content, created by, e.g., a source content author, that viewer 116 wishes to view. Source content 100 may comprise an image, video, or other displayable content type. Element 102 represents the source profile, that is, information describing the color profile and display characteristics of the device on which source content 100 was authored by the source content author. Source profile 102 may comprise, e.g., an ICC profile of the author's device or color space, or other related information.

Information relating to the source content 100 and source profile 102 may be sent to viewer 116's device containing the system 112 for performing gamma adjustment utilizing a LUT 110. Viewer 116's device may comprise, for example, a mobile phone, PDA, portable music player, monitor, television, or a laptop, desktop, or tablet computer. Upon receiving the source content 100 and source profile 102, system 112 may perform a color adaptation process 106 on the received data, e.g., utilizing the COLORSYNC® framework. COLORSYNC® provides several different methods of doing gamut mapping, i.e., color matching across various color spaces. For instance, perceptual matching tries to preserve as closely as possible the relative relationships between colors, even if all the colors must be systematically distorted in order to get them to display on the destination device.

Once the color profiles of the source and destination have been appropriately adapted, image values may enter the framebuffer 108. In some embodiments, the image values entering framebuffer 108 will already have been processed and have a specific implicit gamma, i.e., the Framebuffer Gamma function, as will be described later in relation to FIG. 2. System 112 may then utilize a LUT 110 to perform a so-called "gamma adjustment process." LUT 110 may comprise a two-column table of positive, real values spanning a particular range, e.g., from zero to one. The first column values may correspond to an input image value, whereas the second column value in the corresponding row of the LUT 110 may correspond to an output image value that the input image value will be "transformed" into before being ultimately being displayed on display 114. LUT 110 may be used to account for the imperfections in the display 114's luminance response curve, also known as a transfer function. In other embodiments, a LUT may have separate channels for each primary color in a color space, e.g., a LUT may have Red, Green, and Blue channels in the sRGB color space.

As mentioned above, in some embodiments, the goal of this gamma adjustment system 112 is to have an overall 1.0 gamma boost applied to the content that is being displayed on the display device 114. An overall 1.0 gamma boost corresponds to a linear relationship between the input encoded luma values and the output luminance on the display device 114. Ideally, an overall 1.0 gamma boost will correspond to the source author's intended look of the displayed content. However, as will be described later, this overall 1.0 gamma boost may only be properly perceived in one particular set of ambient lighting conditions, thus necessitating the need for an ambient-aware dynamic display adjustment system.

Figure 2:
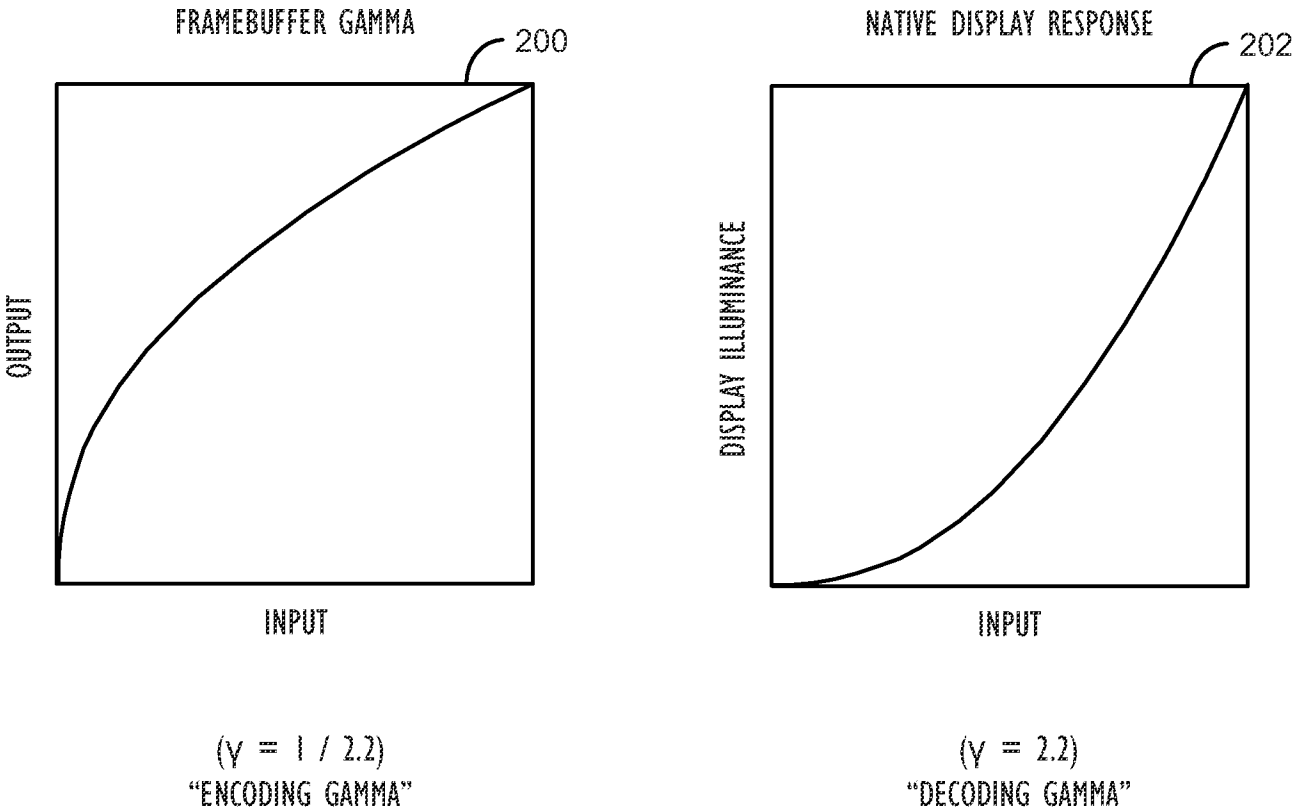
Figure 2 (prior art)
FIG. 2 illustrates a Framebuffer Gamma Function and an exemplary Native Display Response, in accordance with the prior art.

Referring now to FIG. 2, a Framebuffer Gamma Function 200 and an exemplary Native Display Response 202 is shown. The x-axis of Framebuffer Gamma Function 200 represents input image values spanning a particular range, e.g., from zero to one. The y-axis of Framebuffer Gamma Function 200 represents output image values spanning a particular range, e.g., from zero to one. As mentioned above, in some embodiments, image values may enter the framebuffer 108 already having been processed and have a specific implicit gamma. As shown in graph 200 in FIG. 2, the encoding gamma is roughly 1/2.2, or 0.45. That is, the line in graph 200 roughly looks like the function, $L_{OUT}=L_{IN}^{0.45}$. Gamma values around 1/2.2, or 0.45, are typically used as encoding gammas because the native display response of many display devices have a gamma of roughly 2.2, that is, the inverse of an encoding gamma of 1/2.2.

The x-axis of Native Display Response Function 202 represents input image values spanning a particular range, e.g., from zero to one. The y-axis of Native Display Response Function 202 represents output image values spanning a particular range, e.g., from zero to one. In theory, systems in which the decoding gamma is the inverse of the encoding gamma should produce the desired overall 1.0 gamma boost. However, this system does not take into account the effect on the viewer due to ambient light in the environment around the display device. Thus, the desired overall 1.0 gamma boost is only achieved in one ambient lighting environment, and this environment is brighter than normal office or workplace environments.

Figure 3:
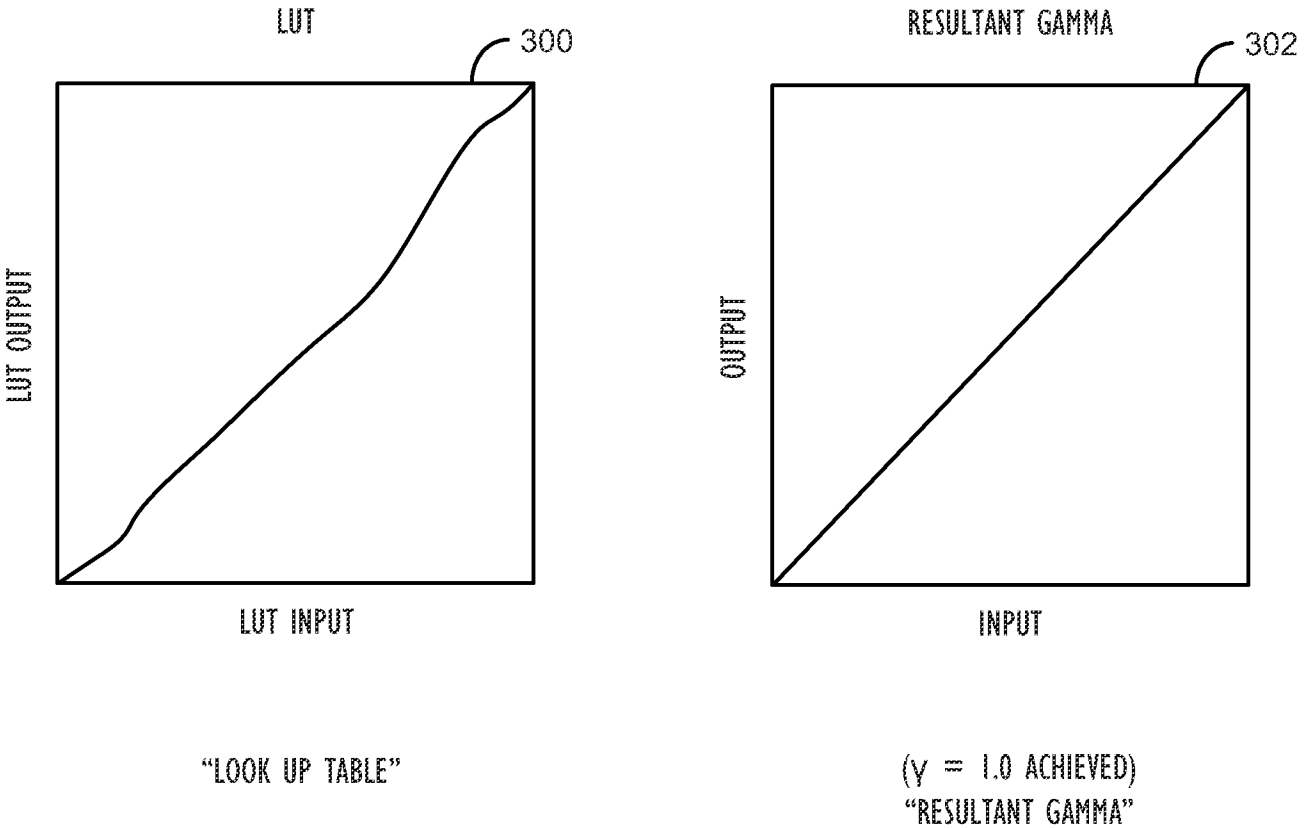
Figure 3 (prior art)
FIG. 3 illustrates a graph representative of a LUT transformation and a Resultant Gamma Function, in accordance with the prior art.

Referring now to FIG. 3, a graph representative of a LUT transformation 300 and a Resultant Gamma Function 302 are shown. The graphs in FIG. 3 show how, in an ideal system, a LUT may be utilized to account for the imperfections in the relationship between the encoding gamma and decoding gamma values, as well as the display's particular luminance response characteristics at different input levels. The x-axis of LUT graph 300 represents input image values spanning a particular range, e.g., from zero to one. The y-axis of LUT graph 300 represents output image values spanning a particular range, e.g., from zero to one. Resultant Gamma Function 302 reflects a desired overall 1.0 gamma boost resulting from the gamma adjustment provided by the LUT. The x-axis of Resultant Gamma Function 302 represents input image values as authored by the source content author spanning a particular range, e.g., from zero to one. The y-axis of Resultant Gamma Function 302 represents output image values displayed on the resultant display spanning a particular range, e.g., from zero to one. The slope of 1.0 reflected in the line in graph 302 indicates that luminance levels intended by the source content author will be reproduced at corresponding luminance levels on the ultimate display device.

Figure 4:
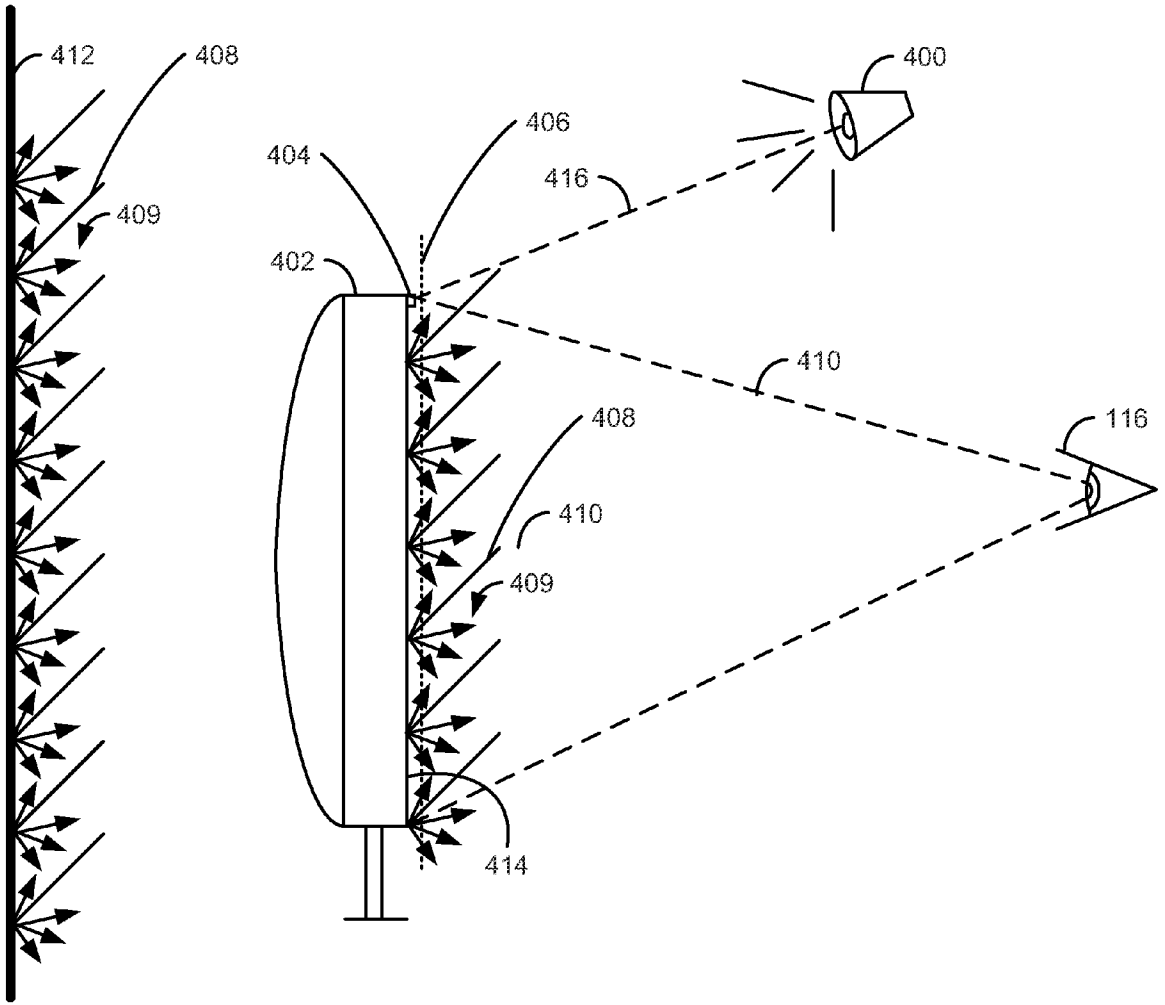
FIG. 4 illustrates the properties of ambient lighting and diffuse reflection off a display device, in accordance with one embodiment.

Referring now to FIG. 4, the properties of ambient lighting and diffuse reflection off a display device are shown via the depiction of a side view of a viewer 116 of a display device 402 in a particular ambient lighting environment. As shown in FIG. 4, viewer 116 is looking at display device 402, which, in this case, is a typical desktop computer monitor. Dashed lines 410 represent the viewing angle of viewer 116. The ambient environment as depicted in FIG. 4 is lit by environmental light source 400, which casts light rays 408 onto all of the objects in the environment, including wall 412 as well as the display surface 414 of display device 402. As shown by the multitude of small arrows 409 (representing reflections of light rays 408), a certain percentage of incoming light radiation will reflect back off of the surface that it shines upon.

One phenomenon in particular, known as diffuse reflection, may play a particular role in a viewer's perception of a display device. Diffuse reflection may be defined as the reflection of light from a surface such that an incident light ray is reflected at many angles. Thus, one of the effects of diffuse reflection is that, in instances where the intensity of the diffusely reflected light rays is greater than the intensity of light projected out from the display in a particular region of the display, the viewer will not be able to perceive tonal details in those regions of this display. This effect is illustrated by dashed line 406 in FIG. 4. Namely, light illuminated from the display surface 414 of display device 402 that has less intensity than the diffusely reflected light rays 409 will not be able to be perceived by viewer 116. Thus, in one embodiment disclosed herein, an ambient-aware model for dynamically adjusting a display's characteristics may reshape the tone response curve for the display such that the most dimly displayed colors don't get masked by predicted diffuse reflection levels reflecting off of the display surface 414. Further, there is more diffuse reflection off of non-glossy displays than there is off of glossy displays, and the ambient model may be adjusted accordingly for display type. The predictions of diffuse reflection levels input to the ambient model may be based off of light level readings recorded by one or more optical sensors, e.g., ambient light sensor 404. Dashed line 416 represents data indicative of the light source being collected by ambient light sensor 404. Optical sensor 404 may be used to collect information about the ambient conditions in the environment of the display device and may comprise, e.g., an ambient light sensor, an image sensor, or a video camera, or some combination thereof. A front-facing image sensor provides information regarding how much light is hitting the display surface. This information may be used in conjunction with a model of the reflective and diffuse characteristics of the display to determine where the black point is for the particular lighting conditions that the display is currently in. Although optical sensor 404 is shown as a "front-facing" image sensor, i.e., facing in the general direction of the viewer 116 of the display device 402, other optical sensor placements and positioning are possible. For example, one or more "back-facing" image sensors alone (or in conjunction with one or more front facing sensors) could give even further information about light sources and the color in the viewer's environment. The back-facing sensor picks up light re-reflected off objects behind the display and may be used to determine the brightness of the display's surroundings. This information may be used to adapt the display's gamma function. For example, the color of wall 412, if it is close enough behind display device 402 could have a profound effect on the viewer's perception. Likewise, in the example of an outdoor environment, the color of light surrounding the viewer can make the display appear to differently than it would an indoor environment with neutral colored lighting.

In one embodiment, the optical sensor 404 may comprise a video ca era capable of capturing spatial information, color information, as well as intensity information. Thus, utilizing a video camera could allow for the creation of an ambient model that could adapt not only the gamma, and black point of the display device, but also the white point of the display device. This may be advantageous due to the fact that a fixed white point system is not ideal when displays are viewed in environments of varying ambient lighting levels and conditions. In some embodiments, a video camera may be configured to capture images of the surrounding environment for analysis at some predetermined time interval, e.g., every two minutes, thus allowing the ambient model to be gradually updates as the ambient conditions in the viewer's environment change.

Additionally, a back-facing video camera intended to model the surround could be designed to have a field of view roughly consistent with the calculated or estimated field of view of the viewer of the display. Once the field of view of the viewer is calculated or estimated, e.g., based on the size or location of the viewer's facial features as recorded by a front-facing camera, assuming the native field of view of the back-facing camera is known and is larger than the field of view of the viewer, the system may then determine what portion of the back-facing camera image to use in the surround computation. This "surround cropping" technique may also be applied to the white point computation for the viewer's surround.

Figure 5:
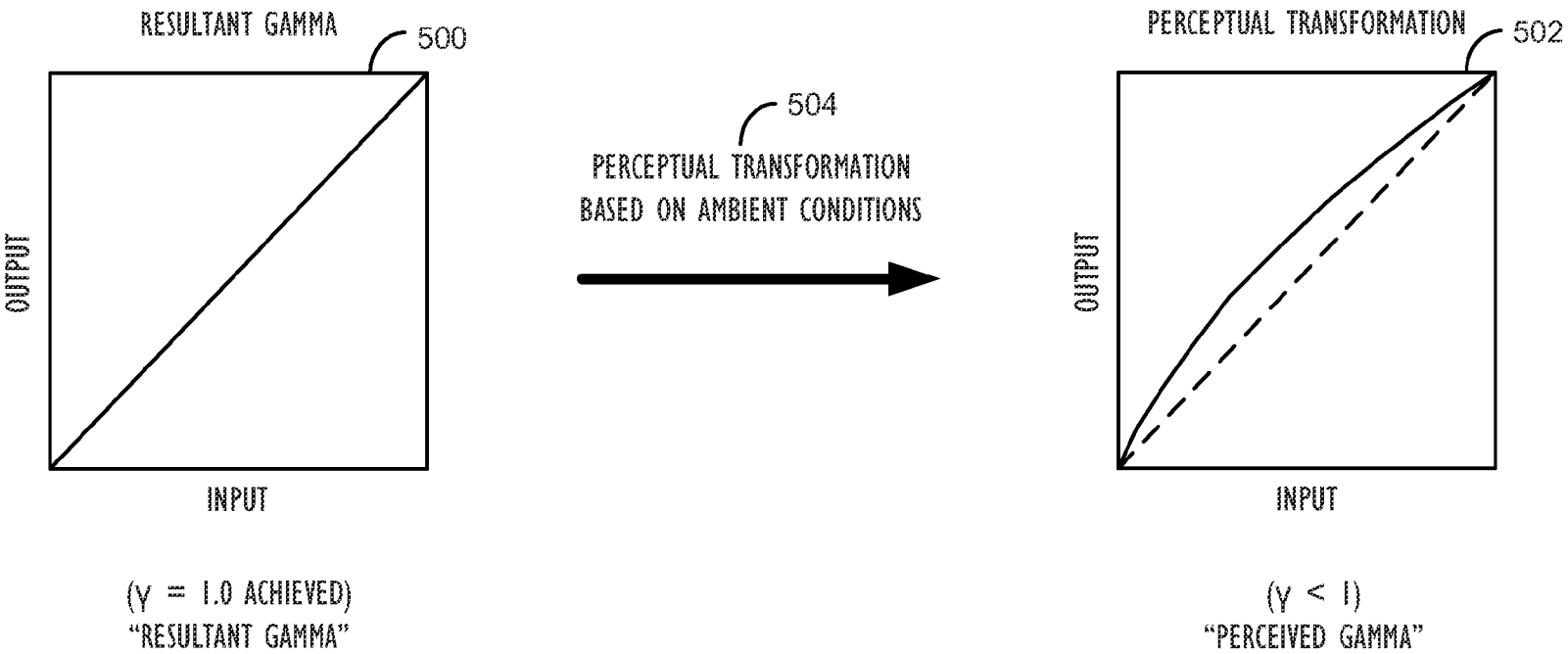
FIG. 5 illustrates a Resultant Gamma Function and a graph indicative of a perceptual transformation, in accordance with one embodiment.

Referring now to FIG. 5, a Resultant Gamma Function 500 and a graph indicative of a perceptual transformation caused by ambient conditions 502 are shown. As mentioned above in reference to graph 302 in FIG. 3, ideally, the Resultant Gamma Function 500 reflects a desired overall 1.0 gamma boost on the resultant display device. The slope of 1.0 reflected in the line in graph 500 indicates that the tone response curves (i.e., gamma) are matched between the source and the display and that the age on the display is likely being displayed more or less as the source's author intended. However, this calculated overall 1.0 gamma boost does not take into account the effect on the viewer's perception due to differences in ambient light conditions. In other words, due to perceptual transformations that are caused by ambient conditions in the viewer's environment 504, the viewer does not perceive the desired overall 1.0 gamma boost in all lighting conditions. As is shown in graph 502, the dashed line indicates an overall 1.0 gamma boost, whereas the solid line indicates the viewer's actual perception of gamma, which corresponds to an overall gamma boost that is not equal to 1.0. Thus, an ambient-aware model for dynamically adjusting a display's characteristics according to embodiments disclosed herein may be able to account for the perceptual transformation based on the viewer's ambient conditions and present the viewer with what he or she will perceive as the desired overall 1.0 gamma boost.

Figure 6:
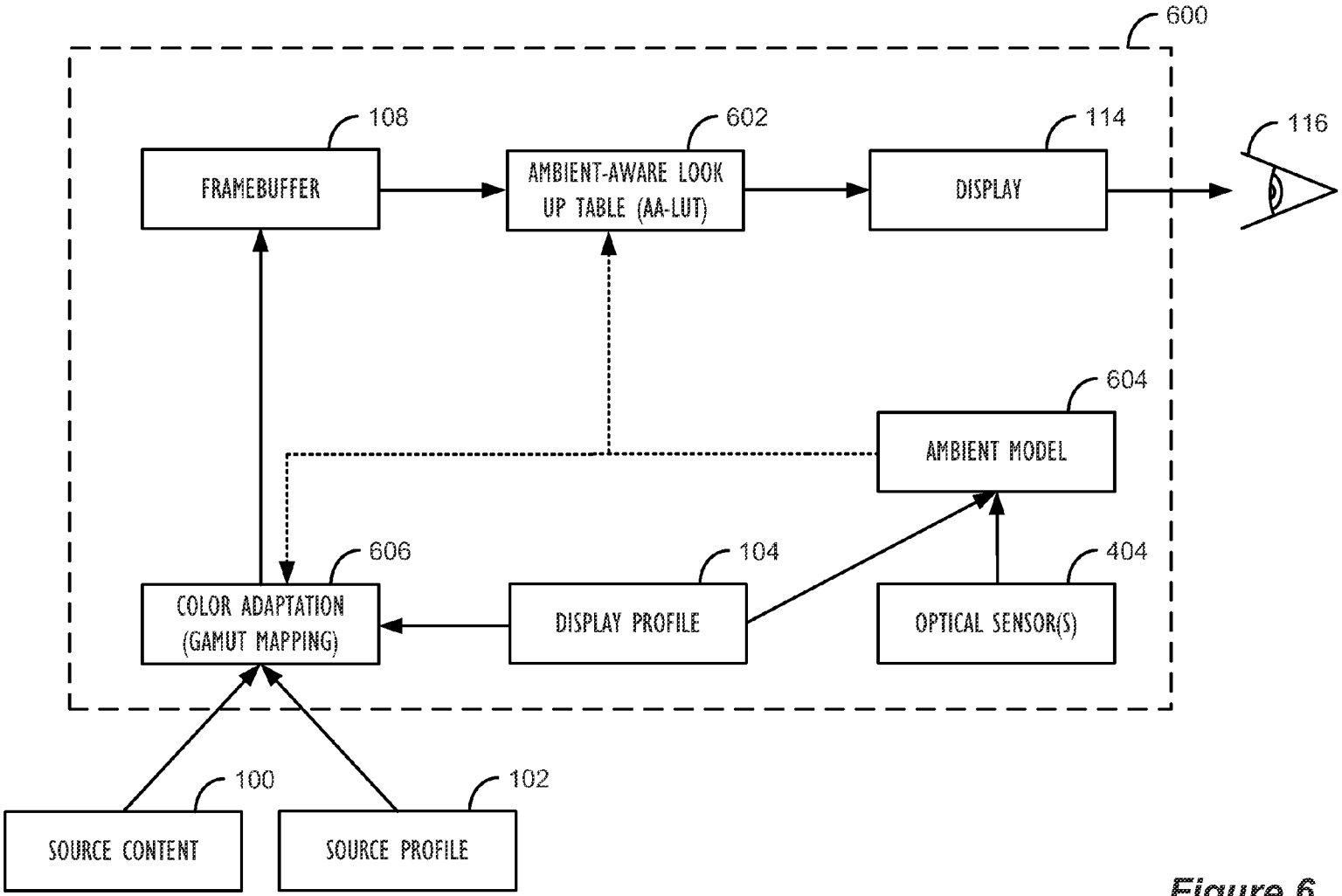
FIG. 6 illustrates a system for performing ambient-aware dynamic display adjustment, in accordance with one embodiment.

Referring now to FIG. 6, a system 600 for performing gamma adjustment, black point compensation, and/or white point adjustment utilizing an ambient-aware Look Up Table (AA-LUT) 602 and an ambient model 604 is shown. The system depicted in FIG. 6 is similar to that depicted in FIG. 1, with the addition of ambient model 604 and, in some embodiments, an enhanced color adaptation model 606. Ambient model 604 may be used to take information indicative of ambient light conditions from one more optical sensors 404, as well as information indicative of the display profile 104's characteristics, and utilize such information to predict the effect on the viewer's perception due ambient conditions and/or improve the display device's tone response curve for the display device's particular ambient environment conditions.

One embodiment of an ambient-aware model for dynamically adjusting a display's characteristic disclosed herein takes information from one or more optical sensors 404 and display profile 104 and makes a prediction of the effect on viewing conditions and the viewer's perception due to ambient conditions. The result of that prediction is used to determine how system 600 modifies the LUT, such that it now serves as an "ambient-aware" LUT 602. The modifications to the LUT may comprise modifications to add or remove gamma from the system or to modify the black point or white point of the system. "Black point" may be defined as the level of light intensity below which no further detail may be perceived by a viewer, "White point" may be defined as the set of values that serve to define the color "white" in the color space.

In one embodiment, the black level for a given ambient environment is determined, e.g., by using an ambient light sensor 404 or by taking measurements of the actual panel and/or diffuser of the display device. As mentioned above in reference to FIG. 4, diffuse reflection of ambient light off the surface of the device may mask a certain range of the darkest display levels. Once this level of diffuse reflection is determined, the black point may be adjusted accordingly. For example, if all luminance values below an 8-bit value of 40 would be imperceptible over the level of diffuse reflection (though this is likely an extreme example), the system 600 may set the black point to be 40, thus compressing the pixel luminance values into the range of 41-255. In one particular embodiment, this "black point compensation" is performed by "stretching" or otherwise modifying the values in the LUT, as is discussed further below in reference to FIG. 9.

In another embodiment, the white point for a given ambient environment may be determined, e.g., by using an image sensor or video camera to determine the white point in the viewer's surround by analyzing the lighting and color conditions of the ambient environment. The white point for the display device may then be adapted to be the determined white point from the viewer's surround. In one particular embodiment, this modification, or "white point adaptation," is performed by "stretching" or otherwise modifying the values in the LUT such that the color "white" for the display is defined by finding the appropriate "white point" in the user's ambient environment, as is discussed further below in reference to FIG. 9. Additionally, modifications to the white point may be asymmetric between the LUT's Red, Green, and Blue channels, thereby moving the relative RGB mixture, and hence the white point.

In another embodiment, a color appearance model (CAM), such as the CIECAM02 color appearance model, provides the model for the appropriate gamma boost, based on the brightness and white point of the user's surround, as well as the field of view of the display subtended by the user's field of vision. In some embodiments, knowledge of the size of the display and the distance between the display and the user may also serve as useful inputs to the model. Information about the distance between the display and the user could be retrieved from a front-facing image sensor, such as front-facing camera 404. For example, for pitch black ambient environments, an additional gamma boost of about 1.5 imposed by the LUT may be appropriate, whereas a 1.0 gamma boost (i.e., "unity," or no boost) may be appropriate for a bright or sun-lit environment. For intermediate surrounds, appropriate gamma boost values to be imposed by the LUT may be interpolated between the values of 1.0 and about 1.5. A more detailed model of surround conditions is provided by the CIECAM02 specification.

In the embodiments described immediately above, the LUT 602 serves as a useful and efficient place for system 600 to impose these supplemental ambient-based TRC transformations. It may be beneficial to use the LUT to implement these ambient-based TRC transformations because the LUT: 1) easily modifiable, and thus convenient; 2) changes properties for the entire display device; 3) won't add any additional runtime overhead to the system; and 4) is already used to carry out similar style transformations for other purposes, as described above.

In other embodiments, the adjustments determined by ambient model 604 may be applied through an enhanced color adaptation model 606. In some embodiments of an enhanced color adaptation model, gamma-encoded source data may first undergo linearization to remove the encoded gamma. At that point, gamut mapping may take place, e.g., via a color adaptation matrix. At this point in the enhanced color adaptation model, it may be beneficial to adjust the white point of the system based on the viewer's surround while mapping the other color values to the gamut of the display device. Next, the black point compensation for the system could be performed to compensate for the effects of diffusive reflection. At this point in the enhanced color adaptation model, the already color-adapted data may be gamma encoded again based on the display device's characteristics with the additional gamma boost suggested by the CAM due to the user's surround. Finally, the data may be processed by the LUT and sent to the display. In those embodiments wherein the adjustments determined by ambient model 604 are applied through the enhanced color adaptation model 606, no further modifications of the device's LUT table are necessary. In certain circumstances, it may be advantageous to impose the adjustments determined by ambient model 604 through the enhanced color adaptation model 606 rather than LUT. For example, adjusting the black point compensation during the color adaption stage could allow for the use of dithering to mitigate banding in the resultant display. Further, setting the white point while in linear space, i.e., at the time of gamut mapping, may be preferable to setting the white point using gamma encoded data, e.g., because of the ease of performing matrix operations in the linear domain, although transformations may also be performed in the non-linear domain if needed.

Figure 7:
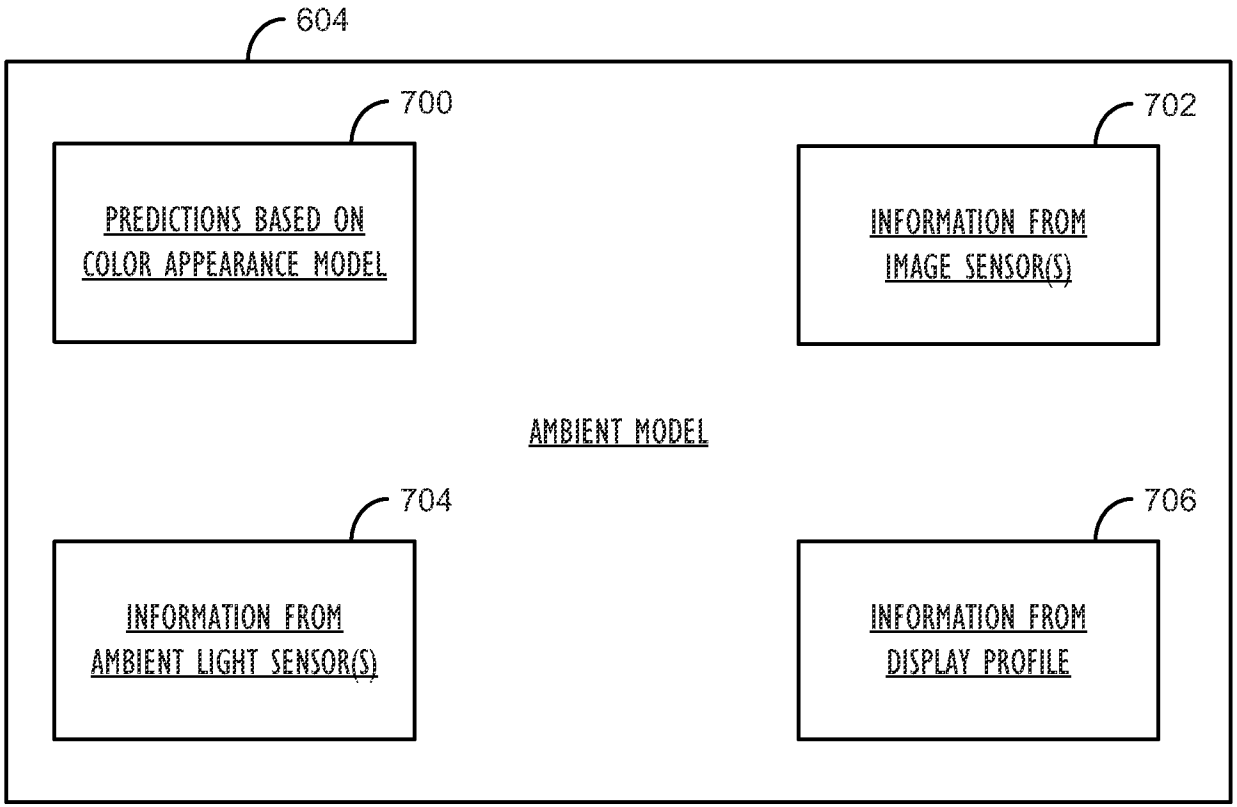
FIG. 7 illustrates a simplified functional block diagram of an ambient model, in accordance with one embodiment.

Referring now to FIG. 7, a simplified functional block diagram of ambient model 604 is shown. As is shown in FIG. 7, the ambient model 604 may consider predictions from a color appearance model 700, information from image sensor(s) 702 (e.g., information indicative of diffuse reflection levels), information from ambient light sensor(s) 704, and information and characteristics from the display profile 706. Color appearance model 700 may comprise, e.g., the CIECAM02 color appearance model or the CIECAM97s model. Display profile 706 information may comprise information regarding the display device's color space, native display response characteristics or abnormalities, or even the type of screen surface used by the display. For example, an "anti-glare" display with a diffuser will "lose" many more black levels at a given (non-zero) ambient light level than a glossy display will. The manner in which ambient model 604 processes information received from the various sources 700/702/704/706, and how it modifies the resultant tone response characteristics of the display, e.g., by modifying LUT values or via an enhanced color adaptation model, are up to the particular implementation and desired effects of a given system.

Figure 8:
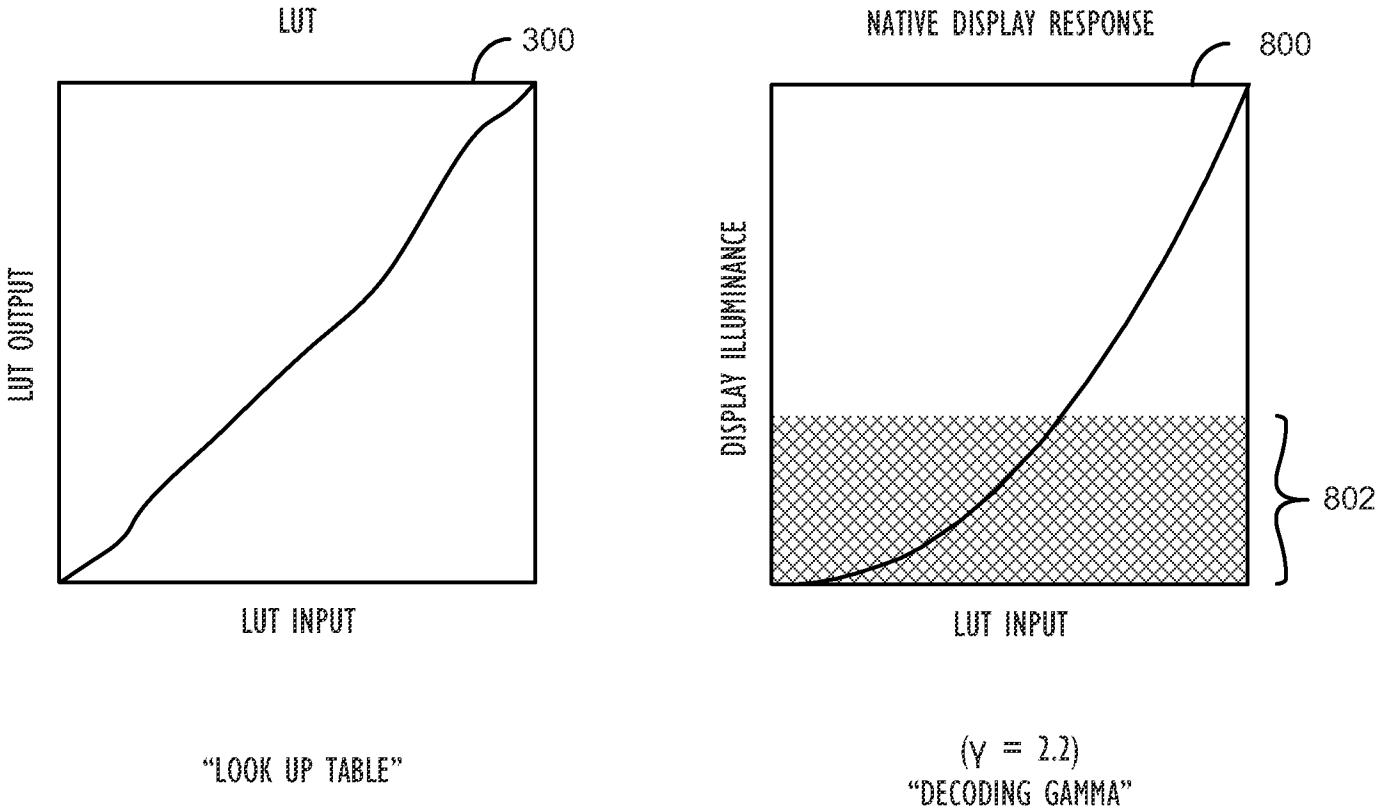
FIG. 8 illustrates a graph representative of a LUT and a graph representative of display illuminance levels that are masked by re-reflected ambient light, in accordance with one embodiment.

Referring now to FIG. 8, a graph 300 representative of a LUT and a graph 800 representative of display illuminance levels that are masked by re-reflected ambient light are shown, in accordance with one embodiment. As mentioned above in reference to FIG. 3, the x-axis of LUT graph 300 represents input image values spanning a particular range, e.g., from zero to one. The y-axis of LUT graph 300 represents output image values spanning a particular range, e.g., from zero to one. The x-axis of graph 800 represents input image values spanning a particular range, e.g., from zero to one. The y-axis of graph 800 represents the native display response (in terms of illuminance) to input image values spanning the range of the x-axis. Each particular type of display device may have a unique characteristic native display response curve, and there may be minor imperfections along the native display response curve at various input levels, i.e., the display illuminance to a particular input level may not fall exactly on a perfect native display response curve, such as a power function. Such imperfections may be accounted for by empirical determinations which are embodied in the value mappings stored in the LUT. As can be seen from the waviness of line in LUT graph 300, minor imperfections in the native display response may be accounted for by making adjustments to the image values input to the LUT before outputting them to the display. The cross-hatched area 802 in graph 800 is representative of the shadow levels that are masked by diffuse reflection, i.e., the re-reflected ambient light off the display surface of the display device (although this amount of diffuse reflection may be an extreme example). As described above in reference to FIG. 4, shadow details occurring at luminance levels below the level of the diffuse reflection will not be able to be perceived by the user. Thus, as shown in graph 800, input values occurring over the range of the graph where the native display response curve is in cross-hatched region 802 will not be perceived by the viewer because they will not elicit an illuminance response in the display device that is sufficient to overcome the diffuse reflection levels. Thus, it may be beneficial to adjust the black point of the system, such that the lowest input value sent to the LUT will be translated into an image value capable of eliciting an illuminance response in the display device that is sufficient to overcome the diffuse reflection levels.

Figure 9:
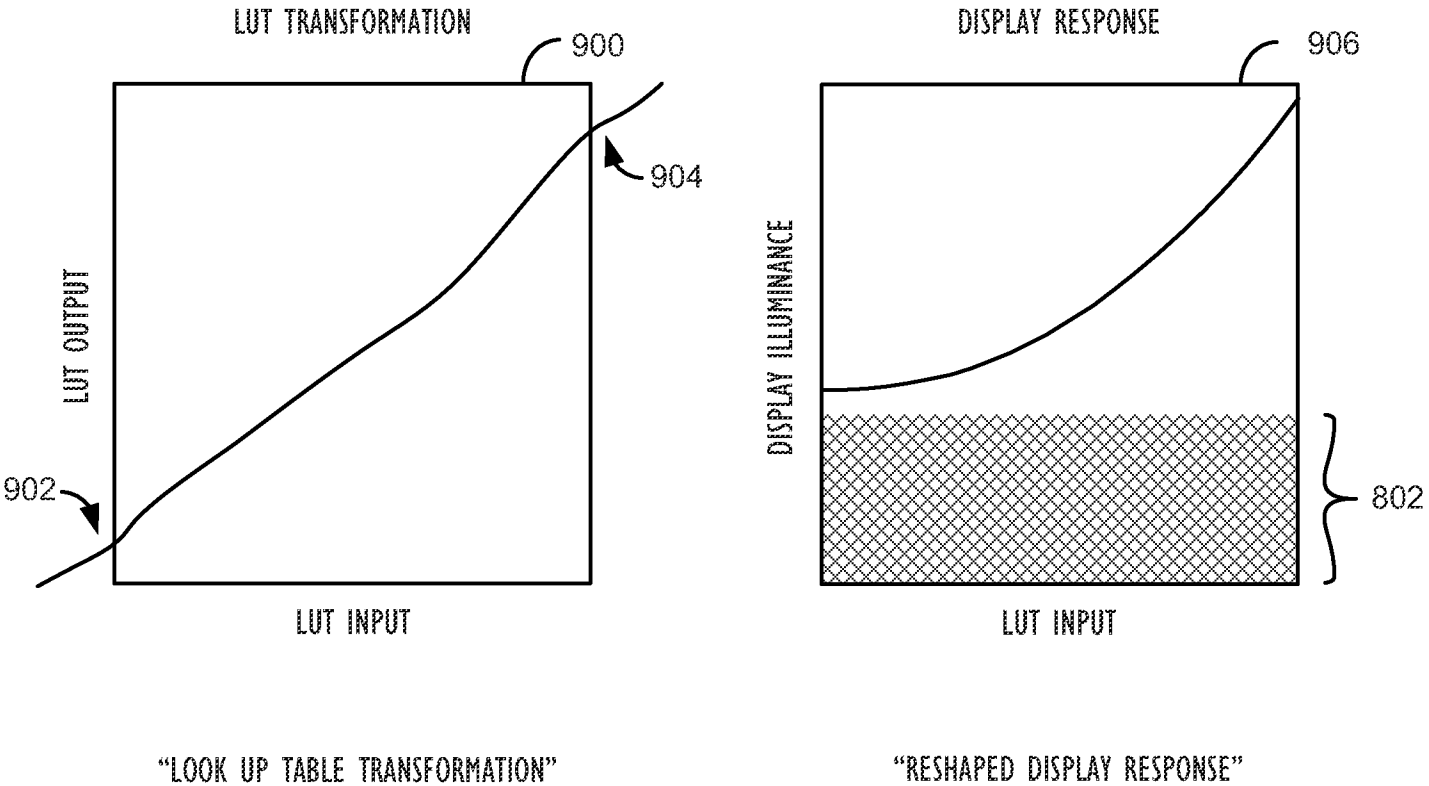
FIG. 9 illustrates a graph representative of a LUT transformation and a graph representative of a reshaped display response curve, in accordance with one embodiment.

Referring now to FIG. 9, a graph 900 representative of a LUT transformation and a graph 906 representative of a reshaped display response curve are shown, in accordance with one embodiment. As mentioned above in reference to FIG. 3, the x-axis of LUT transformation graph 900 represents input image values spanning a particular range, e.g., from zero to one. The y-axis of LUT transformation graph 900 represents output image values spanning a particular range, e.g., from zero to one. As mentioned above in reference to FIG. 8, it may be beneficial to adjust the black point of the system, such that the lowest input value sent to the LUT will be translated into an image value capable of eliciting an illuminance response in the display device that is sufficient to overcome the diffuse reflection levels. One way of adjusting the black point of the system is to modify the values in the LUT. However, in certain embodiments, the LUT may not simply be rewritten because it may already contain important calibrations to correct for imperfections of the display device, as mentioned earlier. Thus, it may be beneficial to "re-sample" the LUT when modifying it.

By re-sampling the LUT to change the black point of the display device's the tone response curve, it may possible to prevent the most dimly illuminated colors from being masked by diffuse reflection off of the monitor. In some embodiments, there may be several transformations involved in this re-sampling process. As one example, the LUT may be "re-sampled" to horizontally stretch its values such that it increases the minimum output value and still maintain the LUT's compensation for imperfections in the monitor at specific illumination levels. As shown in graph 900, the LUT has been horizontally stretched such that its ends extend beyond the lower and upper bounds of the x-axis. This has the effect of increasing the output at the lower, i.e., minimal, input values 902 and decreasing the output at the upper, i.e., maximal, input values 904. The amount that the minimal input value 902 is increased from its original output mapping to a value of zero corresponds to the amount of black point compensation imposed on the system by the LUT re-sampling. In other words, the re-sampling makes it such that no image value lower than LUT output 902 will ever be sent to the display. By stretching the LUT to the point where this minimal output value is sufficient to elicit an illuminance response in the display device that is sufficient to overcome the diffuse reflection levels, the viewer will maintain the ability to perceive shadow detail in the image despite the ambient conditions and/or diffuse reflection.

As is also shown in graph 900, such a re-sampling of the LUT may also affect the white point 904 of the system. Particularly, the amount that the maximum input value 904 is decreased from its original output mapping (e.g., to a value of '1') corresponds to the amount of white point compensation imposed on the system by the LUT re-sampling. In other words, the re-sampling makes it such that no image value greater than LUT output 904 will ever be sent to the display. As mentioned above, it may be more preferable in some embodiments to perform white point compensation during the color adaptation process so that the calculations may be performed on linear RGB data rather than gamma encoded data.

As mentioned above, graph 906 is representative of the reshaped display response curve resulting from the re-sampling of the LUT depicted in graph 900. Particularly, by raising the black point of the system, it may be seen that, even at the lowest input levels, the display response is at an illuminance level brighter than the level of diffuse reflection 800. A consequence of the reshaped display response curve in graph 906 is that a smaller dynamic range of illuminance levels are displayed by the display device, but this is preferable in this situation since the lower illuminance levels were not even capable of being perceived by the viewer of the display device anyway. Compressing the image into a smaller range of display levels may affect the image's tonality, but this may be accounted for by decreasing the gamma imposed by the ambient-aware dynamic display adjustment system.

Figure 10:
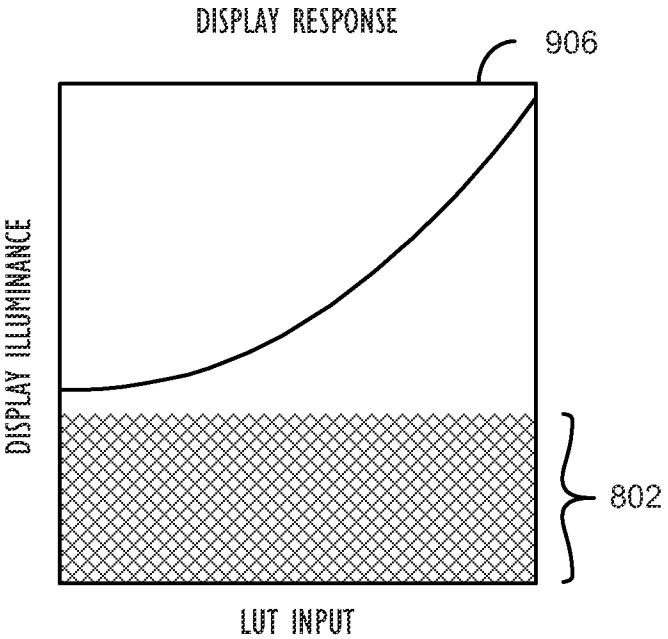
FIG. 10 illustrates a graph representative of a LUT transformation and a graph representative of a reshaped display response curve, in accordance with another embodiment.
Figure 10:
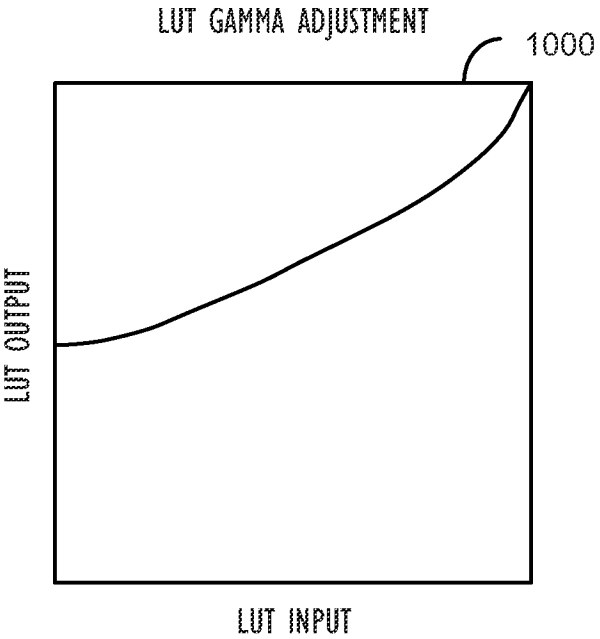

Referring now to FIG. 10, a graph 1000 representative of a LUT transformation and a graph 906 representative of a reshaped display response curve are shown, in accordance with another embodiment. As mentioned above, it may be advantageous in some situations, based on the ambient conditions of the viewer's surround or the amount of black point or white point compensation imposed on the system to add or remove gamma compensation to the system. In one embodiment, this gamma adjustment may be applied via modifications to the LUT. As shown in graph 1000, modifications to the LUT have shifted the line upwards from its position in FIGS. 8 and 9. In some embodiments, the amount of gamma adjustment imposed by the LUT may be proportional to the amount of ambient light in the viewer's surround. For example, for pitch black ambient environments, an additional gamma boost of about 1.5 imposed by the LUT may be appropriate, whereas a 1.0 gamma boost (i.e., "unity," or no boost) may be appropriate for a bright or sun-lit environment. For intermediate surrounds, appropriate gamma boost values to be imposed by the LUT may be interpolated between the values of 1.0 and about 1.5. A more detailed model of surround conditions is provided by the CIECAM02 specification.

Figure 11:
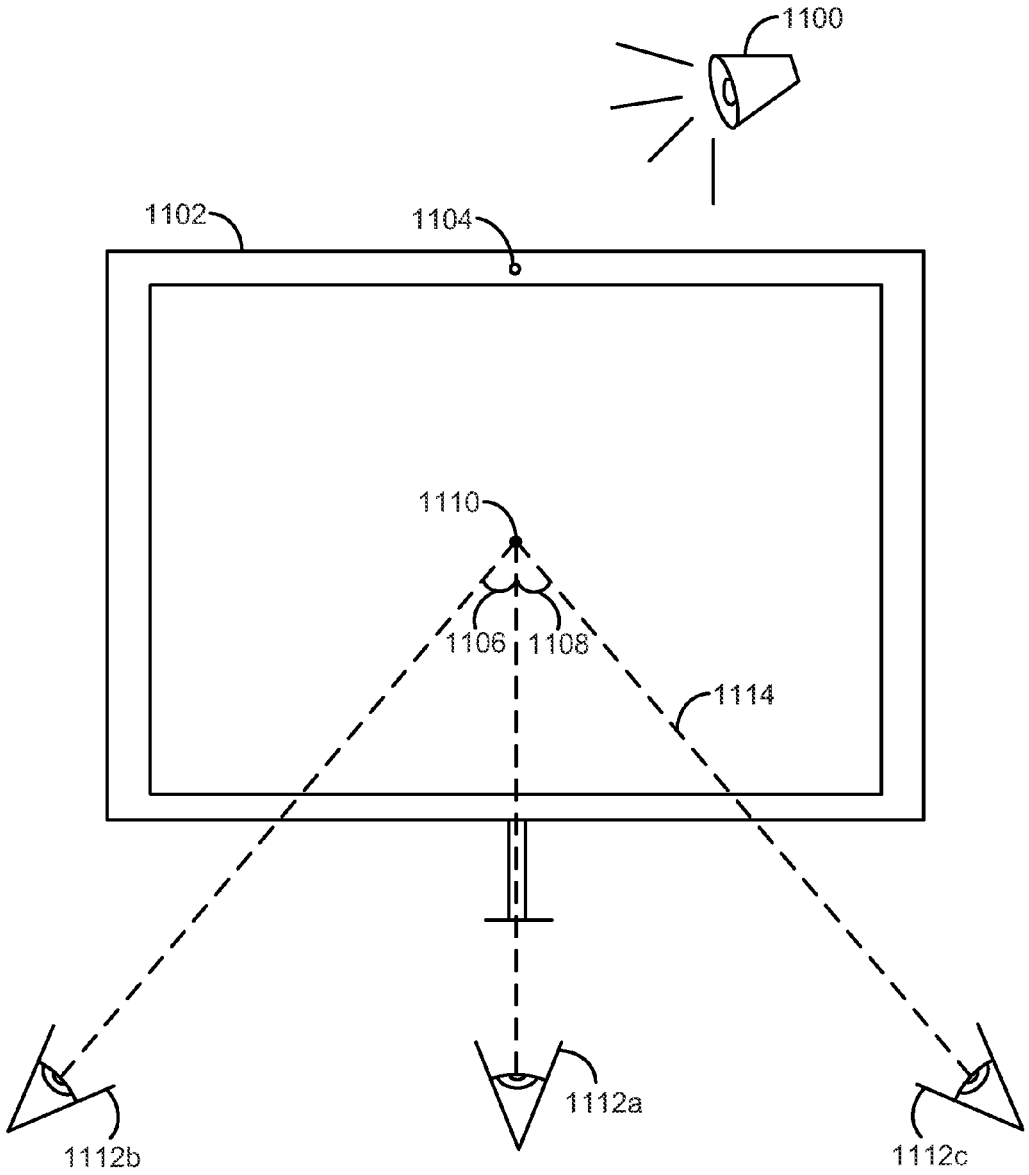
FIG. 11 illustrates a plurality of viewers at different viewing angles to a display device, in accordance with one embodiment.

Referring now to FIG. 11, a plurality of viewers 1112*a-c* at different viewing angles 1106/1108 to a display device 1102 having an optical sensor 1104 are shown. Optical sensor 1104 may gather information indicative of the ambient lighting conditions around display device 1102, e.g., light rays emitted by an environmental light source 1100. Center point 1110 represents the center of display device 1102. Thus, it can be see that viewer 1112*a* is at a zero-offset angle from center point 1110, whereas viewer 1112*b* is at an offset angle 1106 from center point 1110, and viewer 1112*c* is at an offset angle 1108 from center point 1110. In one embodiment, optical sensor 1104 may be an image sensor or video camera capable of performing facial detection and/or facial analysis by locating the eyes of a particular viewer 1112 and calculating the distance 1114 from the display to the viewer, as well as the viewing angle 1106/1108 of the viewer to the display.

These calculations could allow an ambient-aware model for dynamically adjusting a display's characteristic to determine, e.g., how much of the viewer's view is taken up by the device display. Further, by determining what angle the viewer is at with respect to the device display, a GPU-based transformation may be applied to further tailor the display's characteristics (e.g., gamma, black point, white point) to the viewer's position, leading to a more accurate depiction of the source author's original intent and an improved and consistent viewing experience for the viewer.

Figure 12:
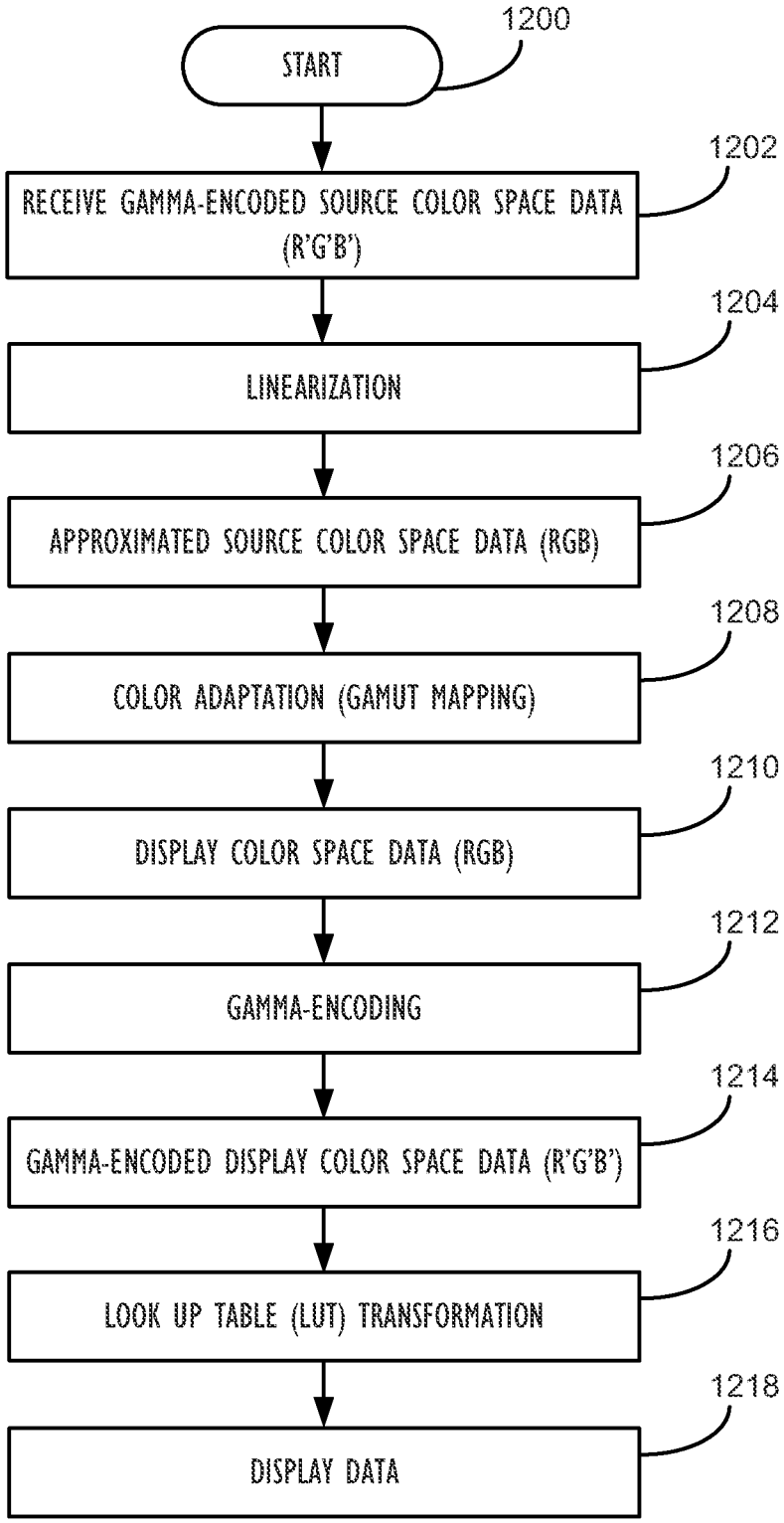
FIG. 12 illustrates, in flowchart form, one embodiment of a process for performing color adaptation.

Referring now to FIG. 12, one embodiment of a process for performing color adaptation is shown in flowchart form. The overall goal of some color adaptation models may be to understand how the source material is ideally intended to "look" on a viewer's display. In a typical scenario for video, the ideal viewing conditions may be modeled as a broadcast monitor, in a dim broadcast studio environment lit by 16 lux of CIE Standard Illuminant D65 light. This source rendering intent may be modeled, e.g., by attaching an ICC profile to the source. The attachment of a profile to the source may allow the display device to interpret and render the content according to the source creator's "rendering intent." Once the rendering intent has been determined, the display device may then determine how to transformation the source content to make it match the ideal appearance on display device, which may (and likely will) be a non-broadcast monitor, in an environment lit by non-D65 light, and with non-16 lux ambient lighting.

First, the color adaptation process may begin at Step 1200. Next the process may proceed by the color adaptation model receiving gamma-encoded data tied to the source color space (R'G'B') (Step 1202). The apostrophe after a given color channel, such as R', indicated that the information for that color channel is gamma encoded. Next the process may perform a linearization process to attempt to remove the gamma encoding (Step 1204). For example if the data has been encoded with a gamma of (1/2.2), the linearization process may attempt to linearize the data by performing a gamma expansion with a gamma of 2.2. After linearization, the color adaptation process will have a version of the data that is approximately representative of the data as it was in the source color space (RGB) (Step 1206). At this point, the process may perform any number of gamut mapping techniques to convert the data from the source color space into the display color space (Step 1208). In one embodiment, the gamut mapping may use a 3×3 color adaptation matrix, such as that employed by the ColorMatch framework. In other embodiments, a 3DLUT may be applied. The gamut mapping process will result in the model having the data in the display device's color space (Step 1210). At this point, the color adaptation process may re-gamma encode the data based on the expected native display response of the display device (Step 1212). The gamma encoding process will result in the model having the gamma encoding data in the display device's color space (Step 1214). At this point, all that is left to do is pass the gamma encoded data to the LUT (Step 1216) to account for any imperfections in the display response of the display device, and then display the data on the display device (Step 1218). While FIG. 12 describes one generalized process for performing color adaptation, many variants of the process exist in the art and may be applied depending on the particular application.

Figure 13:
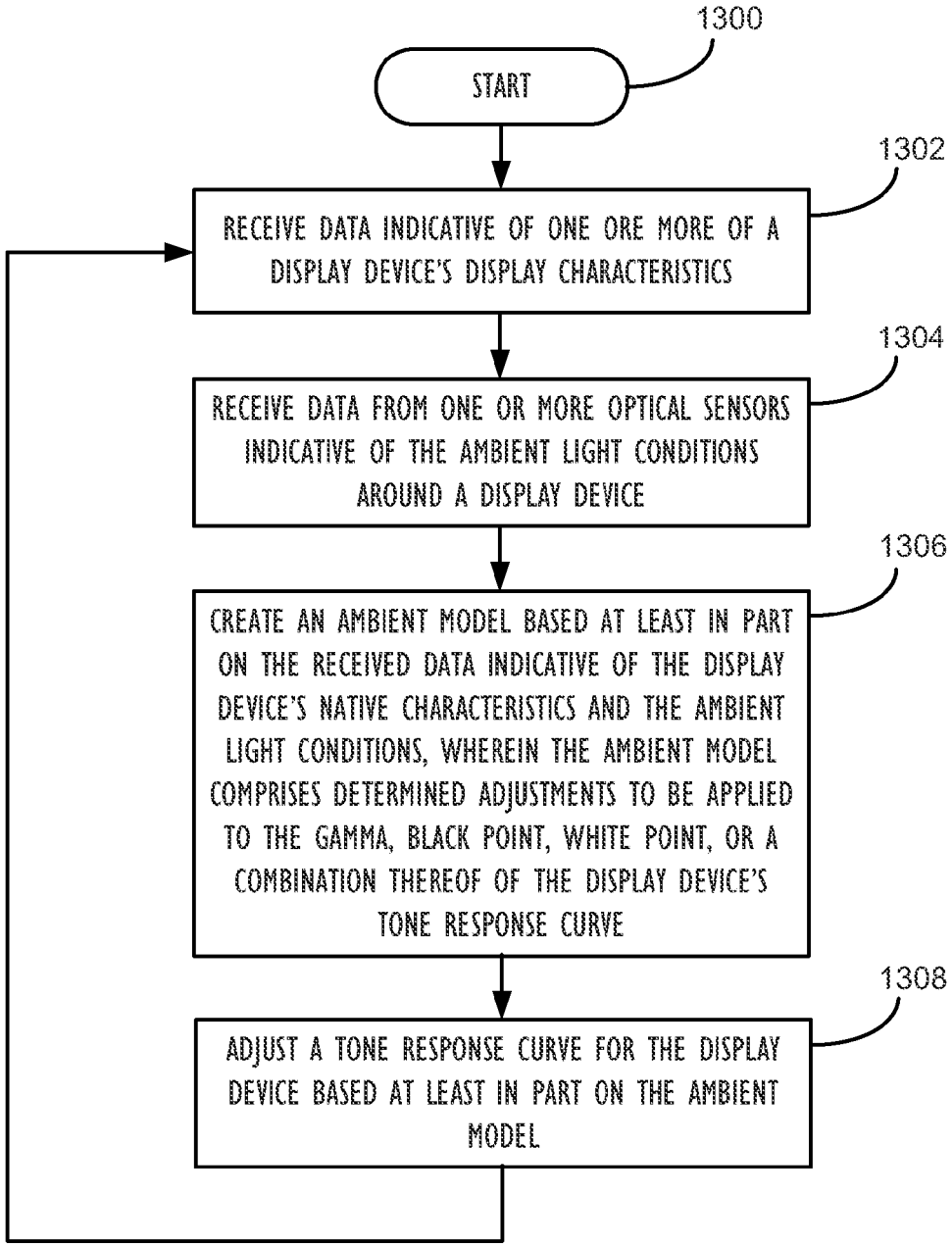
FIG. 13 illustrates, in flowchart form, one embodiment of a process for performing ambient-aware dynamic display adjustment.

Referring now to FIG. 13, one embodiment of a process for performing ambient-aware dynamic display adjustment is shown in flowchart form. First, the process begins at Step 1300. Next, a processor or other suitable programmable control device receives data indicative of one or more of a display device's display characteristics (Step 1302). These may include the display's native response characteristics, or even the type of surface used by the display. Next, the processor receives data from one or more optical sensors indicative of ambient light conditions in the display device's environment (Step 1304). Next, the processor creates an ambient model based at least in part on the received data indicative of the display device's native characteristics and the ambient light conditions, wherein the ambient model comprises determined adjustments to be applied to the gamma, black point, white point, or a combination thereof of the display device's tone response curve (Step 1306). Finally, the processor adjusts a tone response curve for the display device, e.g., by modifying a LUT, based at least in part on the created ambient model (Step 1308), and the process returns to Step 1302 to continue receiving incoming data from the display device and/or one or more optical sensors indicative of ambient light conditions in the display device's environment so that it may dynamically adjust the device's display characteristics.

Figure 14:
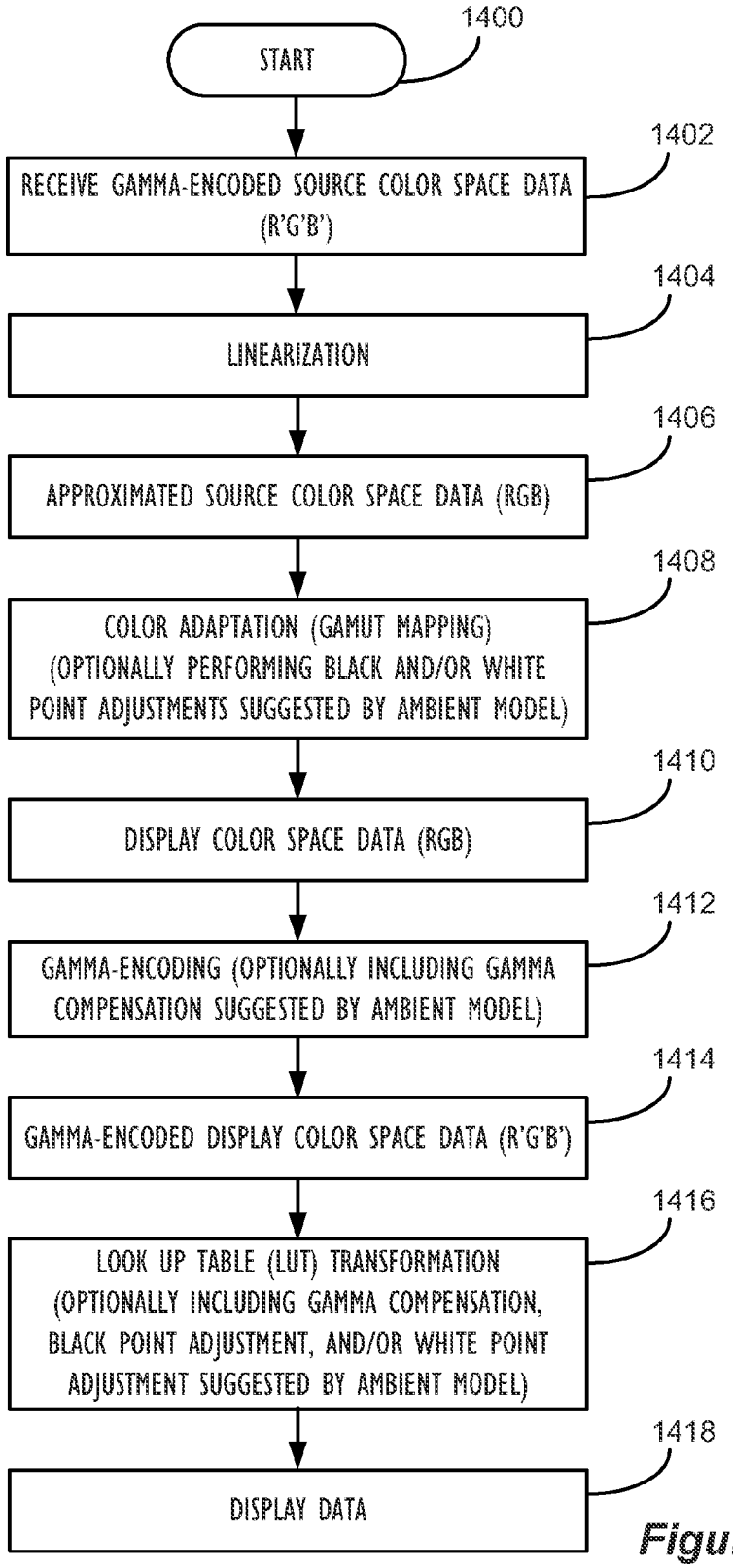
FIG. 14 illustrates, in flowchart form, another embodiment of a process for performing ambient-aware dynamic display adjustment.

Referring now to FIG. 14, another embodiment of a process for performing ambient-aware dynamic display adjustment is shown in flowchart form. This process is similar to the process shown in FIG. 12, with modifications to show potential points in the color adaptation model wherein ambient-aware display modifications may be imposed. First, the color adaptation process may begin at Step 1400. Next the process may proceed by the color adaptation model receiving gamma-encoded data tied to the source color space (R'G'B') (Step 1402). Next the process may perform a linearization process to attempt to remove the gamma encoding (Step 1404). After linearization, the color adaptation process will have a version of the data that is approximately representative of the data as it was in the source color space (RGB) (Step 1406). At this point, the process may perform any number of gamut mapping techniques to convert the data from the source color space into the display color space (Step 1408). In one embodiment, the gamut mapping may be a useful stage to impose the white point compensation suggested by the ambient model. Because the process is working with linear RGB data at this stage, the color white in the source color space may easily be mapped to the newly-determined representation of white for the display color space during the gamut mapping. Further, as an extension to this process, the black point compensation may also be imposed on the display color space. Performing black point compensation at this stage of the process may also advantageously allow for the application of dithering to mitigate banding problems in the resultant display caused by, e.g., the compression of the source material into fewer, visible levels. The gamut mapping process will result in the model having the data in the display device's color space (Step 1410). At this point, the color adaptation process may re-gamma encode the data based on the expected native display response of the display device (Step 1412). In one embodiment, the gamma encoding step may be a useful stage to impose the additional gamma adjustments, i.e., transformations, suggested by the ambient model. The gamma encoding process will result in the model having the gamma encoding data in the display device's color space (Step 1414). At this point, all that is left to do is pass the gamma encoded data to the LUT (Step 1416). As mentioned above, the LUT may be used to impose any modification to the gamma, white point, and/or black point of the display device suggested by the ambient model, as well as to account for any imperfections in the display response of the display device. Finally, the data may be displayed on the display device (Step 1418). While FIG. 14 describes one generalized process for performing ambient-aware color adaptation, many variants of the process may be applied depending on the particular application.

Figure 15:
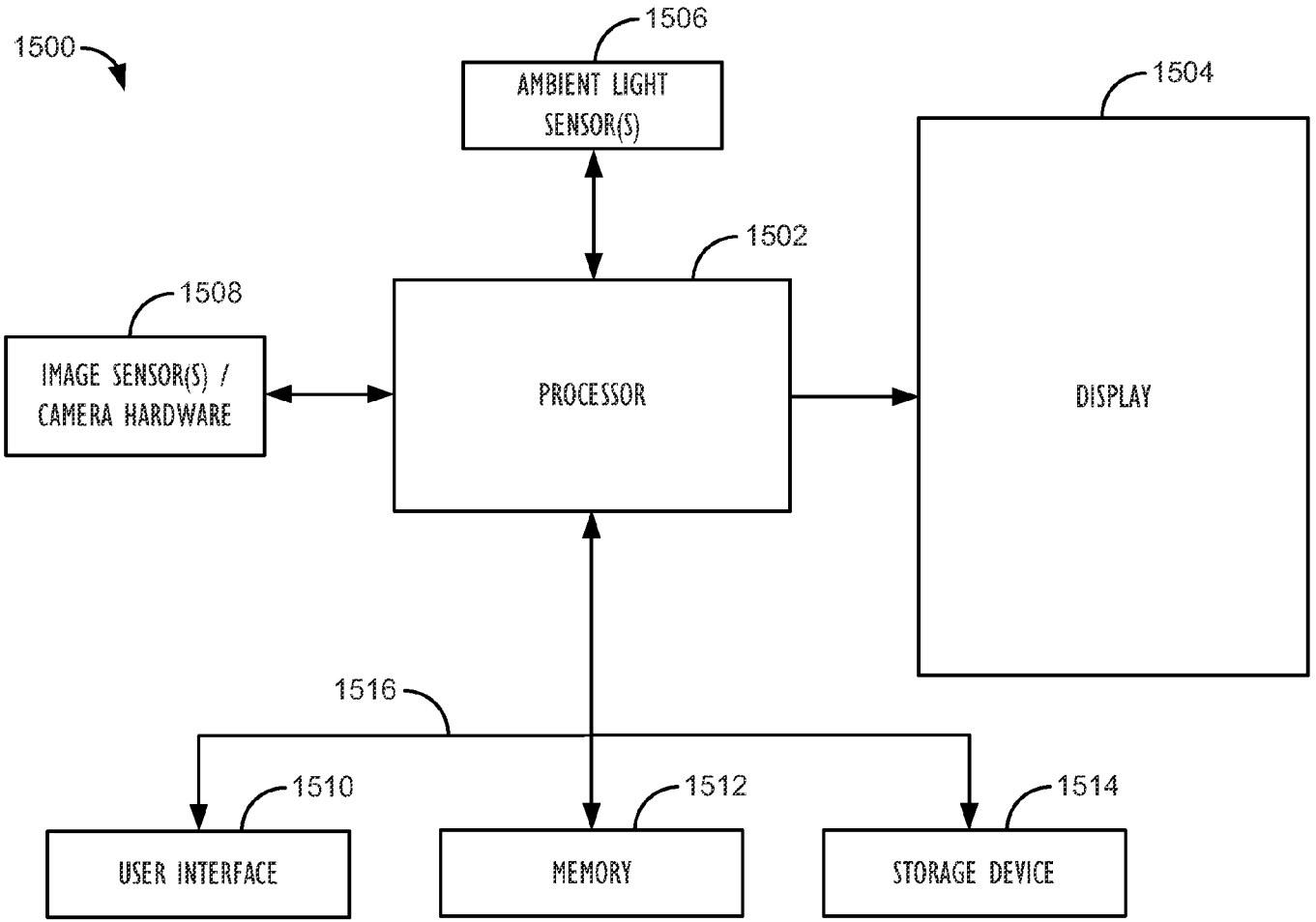
FIG. 15 illustrates a simplified functional block diagram of a device possessing a display, in accordance with one embodiment.

Referring now to FIG. 15, a simplified functional block diagram of a representative electronic device possessing a display 1500 according to an illustrative embodiment, e.g., a desktop computer and monitor possessing a camera device such as front facing camera 404, is shown. The electronic device 1500 may include a processor 1502, display 1504, ambient light sensor 1506, image sensor with associated camera hardware 1508, user interface 1510, memory 1512, storage device 1514, and communications bus 1516. Processor 1502 may be any suitable programmable control device and may control the operation of many functions, such as the creation of the ambient-aware ambient model discussed above, as well as other functions performed by electronic device 1500. Processor 1502 may drive display 1504 and may receive user inputs from the user interface 1510.

Storage device 1514 may store media (e.g., image and video files), software (e.g., for implementing various functions on device 1500), preference information, device profile information, and any other suitable data. Storage device 1514 may include one more storage mediums, including for example, a hard-drive, permanent memory such as ROM, semi-permanent memory such as RAM, or cache.

Memory 1512 may include one or more different types of memory which may be used for performing device functions. For example, memory 1512 may include cache, ROM, and/or RAM. Communications bus 1516 may provide a data transfer path for transferring data to, from, or between at least storage device 1514, memory 1512, and processor 1502. User interface 1510 may allow a user to interact with the electronic device 1500. For example, the user input device 1510 can take a variety of forms, such as a button, keypad, dial, a click wheel, or a touchscreen.

In one embodiment, the personal electronic device 1500 may be a electronic device capable of processing and displaying media such as image and video foes. For example, the personal electronic device 1500 may be a device such as such a mobile phone, personal data assistant (PDA), portable music player, monitor, television, laptop, desktop, and tablet computer, or other suitable personal device.

The foregoing description of preferred and other embodiments is not intended to limit or restrict the scope or applicability of the inventive concepts conceived of by the Applicants. As one example, although the present disclosure focused on desktop computer display screens, it will be appreciated that the teachings of the present disclosure can be applied to other implementations, such as portable handheld electronic devices with display screens. In exchange for disclosing the inventive concepts contained herein, the Applicants desire all patent rights afforded by the appended claims. Therefore, it is intended that the appended dams include all modifications and alterations to the full extent that they come within the scope of the following claims or the equivalents thereof.

What is claimed is:

1. A method, comprising:

receiving data indicative of one or more characteristics of a display, wherein the display is coupled to a display device;

receiving data from one or more optical sensors indicative of ambient light conditions surrounding the display device;

creating an ambient model based at least in part on the received data indicative of the one or more characteristics of the display and the received data indicative of ambient light conditions surrounding the display device; and adjusting a tone response curve for the display based at least in part on the created ambient model by raising a black point of the tone response curve such that illuminance levels of the display masked by diffuse reflection prior to the act of adjusting are no longer masked by diffuse reflection after the act of adjusting has been performed.

2. The method of claim 1, wherein the data indicative of one or more characteristics of the display comprises an ICC profile.

3. The method of claim 1, wherein the one or more optical sensors comprise one or more of the following: an ambient light sensor, an image sensor, and a video camera.

4. The method of claim 1, wherein the act of receiving data from one or more optical sensors indicative of ambient light conditions further comprises receiving data indicative of ambient light conditions from an image sensor facing in the direction of a viewer of the display.

5. The method of claim 1, wherein the act of receiving data from one or more optical sensors indicative of ambient light conditions further comprises receiving data indicative of ambient light conditions from an image sensor facing away from a viewer of the display.

6. The method of claim 1, wherein the act of receiving data from one or more optical sensors indicative of ambient light conditions further comprises receiving data indicative of ambient light conditions from one or more image sensors facing in the direction of a viewer of the display and one or more image sensors facing away from the viewer of the display.

7. The method of claim 1, wherein the act of receiving data from one or more optical sensors indicative of ambient light conditions further comprises receiving data indicative of ambient light conditions from one or more video cameras.

8. The method of claim 7, wherein the data indicative of ambient light conditions comprises one or more of the following: spatial information data, color information data, field of view information data, and intensity information data.

9. The method of claim 7, wherein at least one video camera is configured to capture images indicative of the ambient conditions at predetermined time intervals.

10. The method of claim 1, wherein the act of creating an ambient model further comprises predicting the effect on a viewer of the display due to the ambient light conditions, and wherein the act of adjusting a tone response curve for the display based at least in part on the created ambient model further comprises modifying a gamma of the tone response curve according to the predicted effect on the viewer of the display due to the ambient light conditions.

11. The method of claim 10, wherein the act of modifying the gamma of the tone response curve further comprises modifying one or more values in a Look Up Table (LUT).

12. The method of claim 11, wherein the act of modifying one or more values in the LUT comprises re-sampling the values in the LUT.

13. The method of claim 10, wherein the act of modifying the gamma of the tone response curve further comprises adjusting the gamma of the tone response curve during a gamma encoding process.

14. The method of claim 1, wherein the act of adjusting the tone response curve for the display based at least in part on the created ambient model further comprises modifying the white point of the display.

15. The method of claim 14, wherein the act of modifying the white point of the display is based at least in part on the ambient light conditions surrounding the display device.

16. The method of claim 14, wherein the act of modifying the white point of the display is based at least in part on a determination of a distance between the display and a viewer of the display.

17. A non-transitory computer usable medium having a computer readable program code embodied therein, wherein the computer readable program code is adapted to be executed to implement the method of claim 1.

18. A method, comprising:

receiving data indicative of ambient light conditions surrounding a display device;

receiving data indicative of a location of a viewer of the display device;

predicting an effect on the viewer of the display device due to the ambient light conditions and the location of the viewer; and adjusting a tone response curve for a display of the display device based at least in part on the predicted effect on the viewer by raising a black point of the tone response curve such that illuminance levels of the display masked by diffuse reflection prior to the act of adjusting are no longer masked by diffuse reflection after the act of adjusting has been performed.

19. The method of claim 18, wherein the data indicative of the location of the viewer of the display comprises one or more of the following: a distance from the display device to the viewer of the display device, and a viewing angle of the viewer to the display.

20. The method of claim 18, wherein the act of adjusting the tone response curve for the display further comprises adjusting a gamma, white point, or a combination thereof, of the tone response curve.

21. The method of claim 18, wherein the act of adjusting the tone response curve for the display further comprises one or more of the following: performing a transformation on the tone response curve and modifying one or more values in a Look Up Table (LUT).

22. A method, comprising:

receiving data indicative of ambient light conditions surrounding a display device;

predicting an effect on a viewer of a display due to the ambient light conditions; and modifying one or more values in a Look Up Table (LUT) based on the predicted effect on the viewer by raising a black point of a tone response curve for the display device, such that illuminance levels of the display device masked by diffuse reflection prior to the act of modifying are no longer masked by diffuse reflection after the act of modifying has been performed.

23. The method of claim 22, wherein the act of modifying one or more values in the LUT based on the predicted effect on the viewer further comprises modifying: a gamma value, a white point, or a combination thereof, of the tone response curve.

24. The method of claim 22, wherein the act of modifying one or more values in the LUT based on the predicted effect on the viewer further comprises re-sampling the LUT.

25. The method of claim 24, wherein the act of re-sampling the LUT comprises horizontally stretching one or more values in the LUT.

26. The method of claim 22, wherein the data indicative of ambient light conditions comprises one or more of the following: spatial information data, color information data, field of view information data, and intensity information data.

27. An apparatus, comprising:

a display;

one or more optical sensors for obtaining data indicative of ambient light conditions;

memory operatively coupled to the one or more optical sensors; and a processor operatively coupled to the display, the memory, and the one or more optical sensors, wherein the processor is programmed to:

receive data indicative of ambient light conditions from the one or more optical sensors;

create an ambient model based at least in part on the received data indicative of the ambient light conditions and one or more characteristics of the display; and raise a black point of a tone response curve such that illuminance levels of the display masked by diffuse reflection prior to the raising are no longer masked by diffuse reflection after the raising has been performed.

28. The apparatus of claim 27, wherein the apparatus comprises at least one of the following: a mobile phone, a PDA, a portable music player, a monitor, a television, a laptop computer, a desktop computer, and a tablet computer.

29. The apparatus of claim 27, wherein the one or more optical sensors comprise one or more of the following: an ambient light sensor, an image sensor, and a video camera.

* * * * *